US006997455B2

(12) United States Patent
Romine

(10) Patent No.: US 6,997,455 B2
(45) Date of Patent: Feb. 14, 2006

(54) SHEET DESKEWING METHOD AND APPARATUS

(75) Inventor: Michael Jeffery Romine, Escondio, CA (US)

(73) Assignees: Eastman Kodak Company, Rochester, NY (US); Hewlett-Packard Development Co., Houston, TX (US)

( * ) Notice: Subject to any disclaimer, the term of this patent is extended or adjusted under 35 U.S.C. 154(b) by 53 days.

(21) Appl. No.: 10/774,962

(22) Filed: Feb. 9, 2004

(65) Prior Publication Data

US 2005/0175386 A1 Aug. 11, 2005

(51) Int. Cl.
*B65H 7/02* (2006.01)

(52) U.S. Cl. ..... 271/227; 271/228

(58) Field of Classification Search ..... 271/117, 271/118, 227, 228, 265, 250, 236, 270; 400/579
See application file for complete search history.

(56) References Cited

U.S. PATENT DOCUMENTS

| | | | | |
|---|---|---|---|---|
| 3,603,446 A | | 9/1971 | Maxey | |
| 4,511,242 A | | 4/1985 | Ashbee et al. | |
| 4,839,674 A | | 6/1989 | Hanagata et al. | |
| 4,971,304 A | * | 11/1990 | Lofthus | 271/227 |
| 5,078,384 A | | 1/1992 | Moore | |
| 5,090,683 A | * | 2/1992 | Kamath et al. | 271/227 |
| 5,156,391 A | * | 10/1992 | Roller | 271/227 |
| 5,169,140 A | * | 12/1992 | Wenthe, Jr. | 271/228 |
| 5,172,907 A | * | 12/1992 | Kalisiak | 271/227 |
| 5,678,159 A | | 10/1997 | Williams et al. | |
| 5,715,514 A | | 2/1998 | Williams et al. | |
| 5,794,176 A | * | 8/1998 | Milillo | 702/150 |
| 5,887,996 A | * | 3/1999 | Castelli et al. | 400/579 |
| 5,947,617 A | * | 9/1999 | Kondo | 400/579 |
| 6,098,863 A | | 8/2000 | Hevenor et al. | |
| 6,206,263 B1 | | 3/2001 | Rich et al. | |
| 6,269,995 B1 | | 8/2001 | Rich et al. | |
| 6,276,586 B1 | | 8/2001 | Yeo et al. | |
| 6,283,655 B1 | | 9/2001 | Thomas et al. | |
| 6,411,324 B1 | * | 6/2002 | Christiansen et al. | 347/248 |
| 6,474,634 B1 | * | 11/2002 | Schlageter | 271/10.03 |
| 6,663,103 B1 | * | 12/2003 | Dobberstein et al. | 271/227 |
| 6,895,210 B1 | * | 5/2005 | Quesnel | 399/395 |

* cited by examiner

*Primary Examiner*—Kathy Matecki
*Assistant Examiner*—Rakesh Kumar
(74) *Attorney, Agent, or Firm*—Stephen B. Salai, Esq.; Roger Aceto, Esq.; Harter, Secrest & Emery LLP

(57) ABSTRACT

A method and apparatus for correcting skew of an advancing sheet responsive to the detection of one or the other of aligned fiducial marks located near each of the opposite side edges adjacent the sheet leading edge. Upon detection of a first of the fiducial marks, the advance of the side edge of the sheet associated with the detected fiducial mark is repeatedly dithered rearward and then forward while the opposite side edge of the sheet continues to advance. The dithering of one side edge while continuing the advance of the opposite side edge continues until the other of the fiducial marks is detected after which the advance of the sheet is resumed.

15 Claims, 2 Drawing Sheets

SHEET DESKEWING METHOD AND APPARATUS

CROSS-REFERENCE TO RELATED APPLICATIONS

NONE

STATEMENT REGARDING FEDERALLY SPONSORED RESEARCH OR DEVELOPMENT

Not Applicable

REFERENCE TO A "SEQUENCE LISTING"

Not applicable.

BACKGROUND OF THE INVENTION

1. Field of the Invention

The present invention relates generally to a method and apparatus for correcting skew of a sheet being transported along a path of travel to a processing station. More particularly, the invention relates to transporting a sheet containing a printed image and correcting the alignment of a leading edge of the printed image relative to the entrance of a processing station such as a cutter for cutting the image from the sheet.

2. Description of Related Art

The commercial printing of photographic images on a continuous roll of photographic paper is becoming more and more common. In many such applications, a plurality of images from a customer's order are printed in aligned rows on a segment of the roll and then the segment is cut from the roll. This cutting, sometimes referred to as "post cutting", can create leading and trailing edges that are not precisely aligned with the printed images. These skewed leading and trailing edges cannot be used to align the printed images for subsequent processing, especially for the machine controlled cutting of individual printed images from the segment. In this respect, relying on a leading edge of the segment to orient the entry of the segment into a cutter will result in the cutter likely severing a portion of the printed image when a cut is made.

Accordingly, while it is possible to rely on a leading edge of the segment to orient the segment relative to a cutter, this can be done only in cases where the printed image itself has an aligned relationship with the leading edge. This cannot be done in cases where the leading edge of the segment is skewed relative to the printed image on the segment. Instead, some other reference is required.

Another problem associated with deskewing is maintaining the position of one portion of the segment while correcting the position of another portion in order to bring the two into alignment. For example, pivoting the segment can result in a translation or movement of the pivot point. Movement of the pivot detracts from properly deskewing the segment. Holding a portion of the segment in a fixed position to prevent the pivot point from wandering can cause a wrinkle, bow, or damage to the segment as one portion of the segment is forced to skew about a fixed portion of the segment.

Deskewing sometimes is accomplished by over driving a lagging side of a segment while slowing the advance of a leading side. A drawback here is that the advance of a sheet must be monitored at a number of locations along the path of travel in order to detect when the deskewing is complete.

Accordingly, it is an object of the present invention to provide an improved method and apparatus for correcting the skew of a segment advancing towards a processing station.

Another object is to provide a method and apparatus for deskewing that relies on only two aligned sensing points to resolve an out-of-alignment situation.

A further object is to provide a deskewing method and apparatus that allows a segment to pivot about a fixed pivot point without damaging, wrinkling, or bowing the segment.

Yet another object is to provide a deskewing method and apparatus that accomplishes a deskewing operation by repeatedly reacquiring a single fiducial mark during the course of a deskewing operation.

BRIEF SUMMARY OF THE INVENTION

In the present invention, images first are printed, as by an ink jet printer on photographic paper drawn from a continuous roll. The printer also prints on the paper a pair of aligned fiducial registration marks. These marks are printed at the same time that the images are formed and generally are located slightly in advance of the leading edge of the printed images. After the images are printed, they are cut from the roll and the cut off piece (hereinafter a "sheet") is advanced to a cutter where individual images are cut from the sheet.

For proper cutting, the leading edge of an image must be aligned with a cross cutter. Accordingly, any skew of the sheet must be corrected prior to entering the cutter. To accomplish this, sensors first acquire one or the other of the fiducial marks. The advance of the sheet into the cutter then is delayed until the fiducial marks are brought into proper alignment. Advancing the sheet to the cutter is accomplished by passing the sheet through a nip formed by feed rollers located at the entrance to the cutter. One of the rollers is driven and the other is a backing roller. The aligned fiducial sensors are positioned close to and just after the feed rollers. These fiducial sensors are located so as to detect the fiducial marks just after the leading edge of the sheet passes through the nip.

Two pairs of feed rollers are provided, one at each side edge of the sheet, each pair defining a nip associated respectively with one of the opposite side edge portions of the sheet. The drive roller and backing roll of each pair rotate about common axes. In addition, each drive roller has its own drive motor so it can be driven independently in either direction about the common axis. With this arrangement, the opposite side edge portions of the sheet can be driven independently either in a forward or in a rearward direction.

If the leading edge of the sheet is skewed relative to the leading edge of an image on the sheet, a first of the two sensors will acquire the leading edge of a first fiducial mark before the other sensor acquires the second mark. Should this happen, the motor driving the feed roller associated with the first sensor is stopped and then is placed in a dithering state to repeatedly retract and advance one side of the sheet in the nip. The sensor reacquires the fiducial mark with each subsequent advance during the dithering state. At the same time, the other feed roller continues to advance the opposite side of the sheet in a forward direction. This continues until the second sensor also detects the leading edge of the fiducial mark. Once the second sensor detects the second fiducial mark, both motors first are reversed to back the sheet in the respective nips and then are simultaneously driven in a forward direction to advance the sheet (now properly oriented) into the cutter.

The dithering operation keeps the first detected fiducial mark registered with one sensor by repeatedly bringing it into registration with the sensor while keeping the opposite side of the sheet moving forward. This causes the sheet to turn until the other fiducial mark is brought into registration with the second sensor.

Accordingly, the present invention can be characterized in one aspect thereof by a method of correcting the skew of a sheet being fed to a processing station. The sheet has aligned, machine readable position locators associated respectively with first and second side edges of the sheet wherein a proper orientation of the sheet entering the processing station is defined by an alignment of the position locators. The skew of the sheet is corrected by:

a) advancing the sheet continuously in a forward direction towards the processing station until a first of the position locators is detected, the detection of only one position locator indicating a skewed orientation of the sheet relative to the processing station;

b) dithering, by stepping first rearward and then forward, a side edge of the sheet associated with the detected position locator while continuously advancing the opposite side edge in a forward direction;

c) repeating the dithering of step (b) while continuously advancing the opposite side edge of the sheet until the position locator associated with the opposite side edge is detected; and thereafter d) advancing the sheet in a forward direction to the processing station.

In another aspect, the present invention can be characterized by an apparatus to correct skew of a sheet being fed to a processing station. The sheet has aligned machine readable position locators associated respectively with first and second side edges of the sheet. A proper orientation of the sheet entering the processing station is defined by an alignment of the position locators and the skew correcting apparatus comprises:

a) first and second aligned sensors positioned to detect passage of a respective one of the position locators;

b) independently driven first and second nip rollers engageable against respective opposite side edges of the sheet and being selectively operable to move the sheet in either a forward direction towards the processing station or in a rearward direction;

c) a controller operatively connected to the nip rollers, the controller acting responsive to the detection of a first position locator by the first sensor to dither the first nip rollers, thereby alternately stepping the first nip roller rearward and then forward while continuously operating the second nip roller in a forward direction until both the first and second position locators are simultaneously detected by the respective first and second sensors; and d) the controller acting responsive to the simultaneous detection of the first and second position locators to move both nip rollers in a forward direction.

BRIEF DESCRIPTION OF THE SEVERAL VIEWS OF THE DRAWING(S)

DETAILED DESCRIPTION OF THE INVENTION

Figure 1:
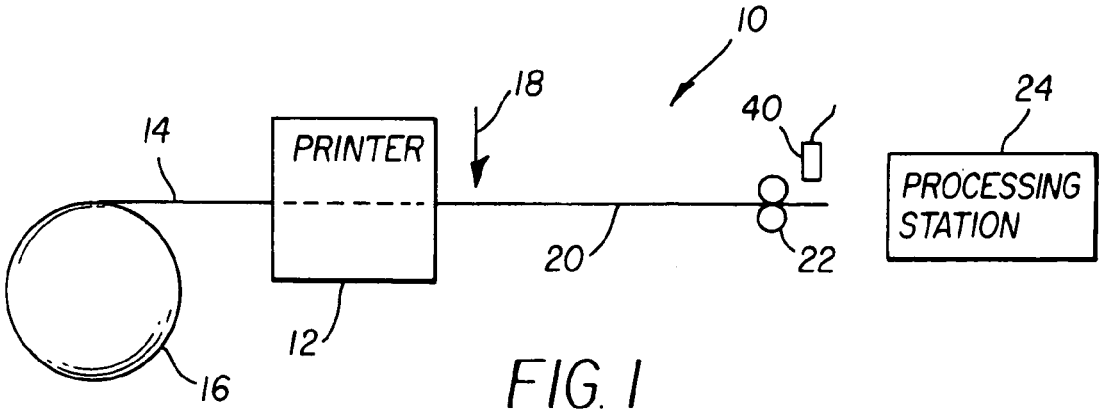
FIG. 1 is a schematic view showing a system employing the skew correcting method and apparatus of the present invention.

Referring to the drawings, FIG. 1 shows a system generally indicated at 10 incorporating the skew correcting mechanism of the present invention. The system preferably includes a printer 12 such as an ink jet printer or the like capable of printing images on a print medium 14 drawn from a supply roll 16. After printing, a post cutter 18 cuts a printed sheet 20 from the roll.

Nip rollers 22 then engage the sheet 20 for advancing it to the entrance of a downstream processing station 24. At the processing station, the sheet is subjected to further processing such as, for example, cross cutting to trim an image printed on the sheet or to sever an image or strip of images from the sheet.

In general, proper processing of the printed sheet at the station 24 requires that the sheet be correctly oriented to the entrance of the processing station. For example, if either the sheet or the image printed on the sheet is skewed relative to the processing station, the cutter at the station will not be properly aligned for cutting. The result is an improper trimming of the image or even cutting through the image. Accordingly, another function of the nip rollers 22 is to correct the skew of the sheet to insure that a leading edge of the sheet or of an image on the sheet is in proper alignment with a cross cutter at the processing station.

In some cases, the leading edge of an image printed on the sheet will be parallel or otherwise properly aligned with the leading edge of the sheet. In such cases, sensors for detecting whether the sheet is skewed or out-of-alignment with the entrance of the processing station can use the sheet leading edge as a point of reference for correcting skew. However, if the image is not so aligned, reliance on the sheet leading edge is improper and some other reference must be used.

Figure 2:
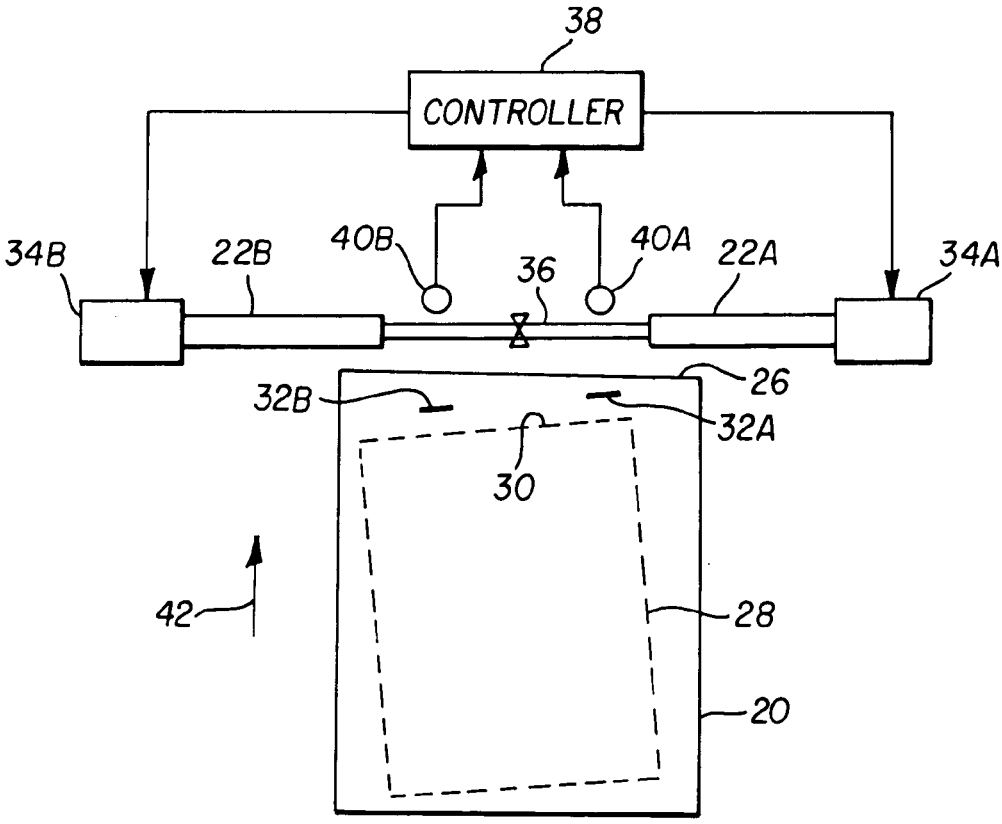
FIG. 2 is a plan view showing components of the present invention in an operative position.

Accordingly, for purposes of describing a preferred embodiment of the present invention, FIG. 2 shows a sheet 20 having a leading edge 26 and a printed area 28. The printed area can comprise a single image or a plurality of images arranged in aligned transverse rows. For purposes of exemplifying the invention, the image leading edge 30 is shown as being skewed on the sheet so that the image leading edge 30 is not parallel to the sheet leading edge 26. This could occur, for example, if the post cutter 18 is not located perpendicular to the path of travel of the sheet.

For reference purposes, the printer 12 is set up to print at least two aligned fiducial registration marks 32 on the sheet at the same time as it prints the image or images 28. The fiducial marks are printed just in advance of and parallel to the image leading edge 30 and provide reference points first to detect and then to correct the sheet skew so as to insure that the image leading edge is properly oriented with the entrance to the processing station 24.

FIG. 2 further shows that there are two sets of nip rollers 22A and 22B, one set being associated with each of the opposite side edge portions of the sheet. These nip rollers are arranged to rotate about a common axis 36 but are independently driven by stepper motors 34A, B respectively. Each nip roller engages its respective sheet edge portion for advancing the sheet to the processing station 24. A controller 38 that can direct each motor to rotate in either direction about the common axis controls the operation of both stepper motors.

A pair of aligned sensors 40 located after the nip rollers 22 detects the passage of the fiducial marks 32, one of the sensors being associated respectively with one of the fiducial marks and nip rollers. An output signal from each sensor is communicated to the controller 38 which then issues an appropriate command to the stepper motors 34 which, in turn, rotate the nip rollers to properly orient the sheet as set out further hereinbelow.

Each sensor preferably provides two signals, either "black" or "white" to the controller. In the first instance, a "black" signal is sent until the sensor detects the passage of the blank leading edge portion of the sheet. When the sheet is detected, the signal changes to "white". The signal then changes back to "black" when a fiducial mark comes into registry with the sensor.

Operation of the invention is described with reference to FIGS. 2–5. FIG. 2 shows the sheet 20 as advancing in a forward direction along a path of travel 42 towards the nip rollers 22A, B. At this point, the sensors are "black" because the sheet is not yet up to the sensors. The Figure further shows that the image leading edge 30 and fiducial registration marks 32 are skewed relative to the direction of travel. Accordingly, for purposes of aligning the image leading edge normal to the path of travel, the sheet 20 must be skewed to the right or clockwise as shown in the FIG. 2.

Figure 3:
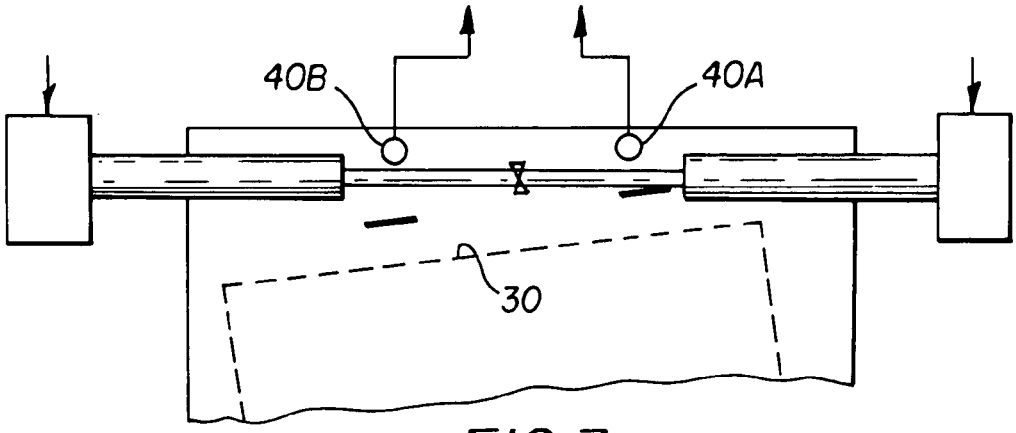
FIGS. 3–5 are plan views partly broken away and on a larger scale illustrating steps in the operation of the method of the present invention.
Figure 4:
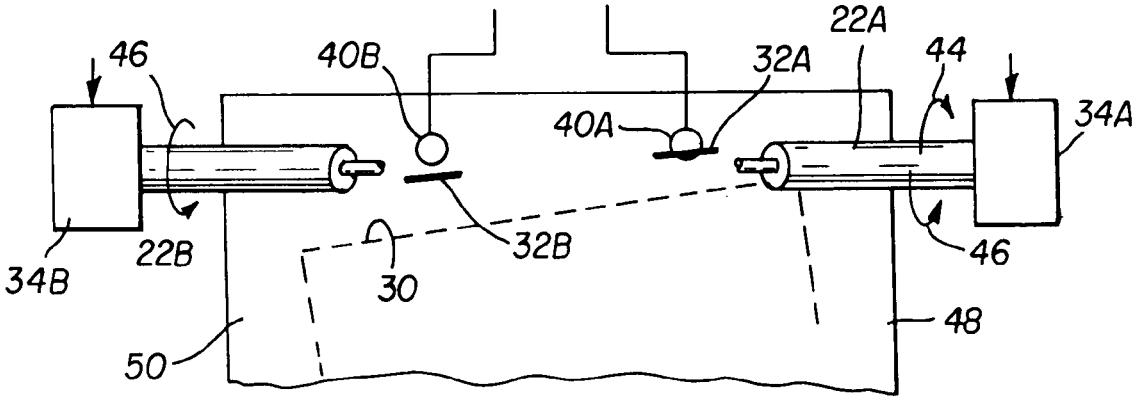

As the sheet enters and passes through the nip rollers, the sensors 40 first turn to "white" as the sheet enters the sensor field of view (FIG. 3). After a further advance, the sensor 40A detects the leading edge of fiducial registration mark 32A and turns "black" sending a signal to the controller that it has acquired a fiducial mark (FIG. 4). However, because of the paper or image skew, the opposite side fiducial mark 32B is not detected by the opposite side sensor 40B and no signal is sent.

In this situation, controller 38 stops the stepper motor 34A and causes it first to step in a reverse direction 44 and then to step in a forward direction 46. Because of this dithering action of motor 34A, the side edge portion 48 of the sheet that is associated with nip rollers 22A first is stepped rearward and then is stepped forward. Concurrently, sensor 40A turns "white" as the leading edge of the fiducial mark moves rearward and out of sensor view and then, immediately afterward, again turns "black" as the side edge portion of the sheet indexes forward and the sensor reacquires the leading edge of the fiducial mark.

The dithering rate depends in part on the transport speed of the sheet. For example, at a sheet transport speed of 1–4 inches/sec., the stepper motor 34B would change direction (dither) about 1 to 10 times per second. Each change in direction would move the side edge portion 48 of the sheet from 1 to 10 mm.

While the controller 38 is dithering stepper motor 34A, the controller continues to cause the opposite side stepper motor 34B to step in a forward direction 46 so the side edge portion 50 of the sheet that is associated with nip rollers 22B continues to advance. As the side edge portion 50 continues to advance, the signal from the sensor 40B is examined continuously for an indication that the leading edge of fiducial mark 32B has been acquired. Accordingly, each time sensor 40A reacquires the leading edge of fiducial mark 32A, and the controller looks for a signal from sensor 40B indicating that it has acquired the leading edge of fiducial mark 32B. If no such signal is received, the controller initiates another back and forward step of motor 34A.

Figure 5:
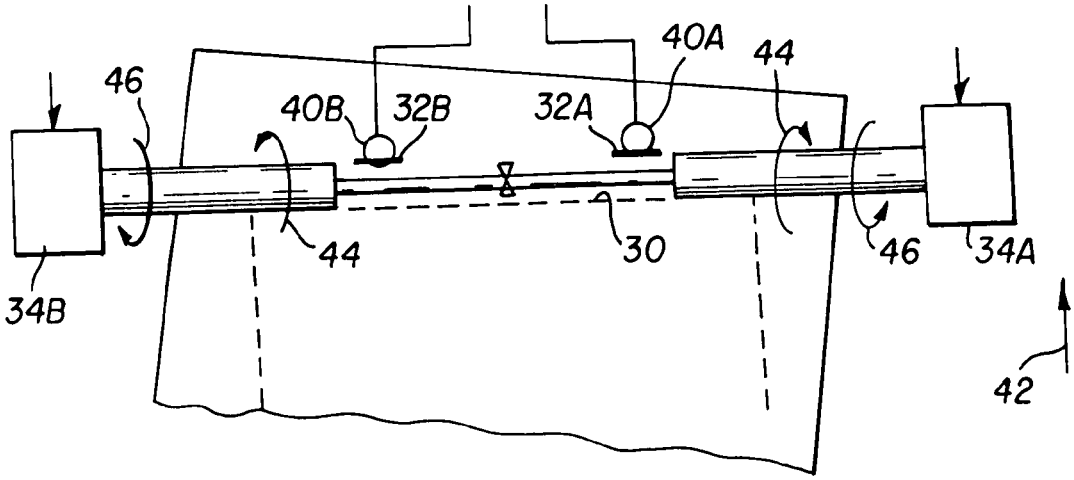

The dithering of motor 34A and the continuous forward motion of the opposite side motor 34B cause the sheet to pivot in a clockwise direction as viewed in the Figures. The pivot point of this action is the leading edge of the fiducial mark 32A within the sight area of the sensor 40A. The dithering of one motor and the continuous forward operation of the opposite side motor continues until the opposite side sensor 40B acquires the leading edge of the second fiducial mark 32B (FIG. 5). This turns the sensor 40B from "white" to black". The controller acts responsive to the signal to stop both motors. The controller then simultaneously steps each motor in the reverse direction 44 (thereby turning both sensors from "black" to "white") and then steps both motors in a forward direction 46.

As the motors step forward, the sheet is advanced along the path of travel 42. If the two sensors 40 simultaneously turn "black" (indicating a simultaneous acquisition of their respective fiducial marks 32 and a proper orientation of the image leading edge), the controller continues forward stepping of both motors to advance the sheet into the processing station 24.

Dithering one motor while continuously operating the other in a forward direction provides several advantages. First, it causes the repeated reacquisition of the fiducial mark leading edge and this maintains a relatively fixed pivot point as defined by that portion of the fiducial mark leading edge coming repeatedly within the sight area of the sensor. At the same time, dithering one side edge portion of the sheet while continuously advancing the opposite side portion of the sheet avoids damaging the portion of the sheet at the pivot point. It also avoids buckling or bowing of the sheet as the sheet is skewed about the pivot.

Thus, it should be appreciated that the present invention accomplishes its intended objects in providing an improved method and apparatus for correcting the skew of a sheet advancing towards a processing station. By employing a dithering motion to hold one side of a sheet while continuously advancing an opposite side, the sheet is caused to pivot about a fixed pivot point without damaging, wrinkling, or bowing the sheet and eliminates the need for multiple sensors along the path of travel.

The invention has been described in the context of a preferred embodiment wherein the deskewing operation relies upon the alignment of fiducial registration marks printed on the sheet that are aligned with the leading edge of an image printed on the sheet. However, it should be appreciated that if the image leading edge is parallel with the sheet leading edge, the leading edge of the sheet itself can perform the same function as the fiducial registration marks. In this case, the controller 38 would act responsive to a simple transition from "black" to "white".

What is claimed is:

1. A method to correct skew of a sheet being fed to a processing station, the sheet having a machine readable position locator adjacent a leading edge of the sheet with first and second portions of the position locator being associated respectively with first and second side edges respectively of the sheet wherein a proper orientation of the sheet entering the processing station being defined by an alignment of the position locator portions, the method comprising:

a) advancing the sheet continuously in a forward direction towards the processing station until only one or another of the position locator portions is detected, the detection of only one locator portion indicating a skewed orientation of the sheet relative to the processing station;

b) dithering, by stepping first rearward and then forward, a side edge of the sheet associated with the detected locator portion while continuously advancing the opposite side edge in a forward direction;

c) repeating the dithering of step (b) while continuously advancing the opposite side edge of the sheet until the locator portion associated with the opposite side edge is detected; and thereafter d) advancing the sheet in a forward direction to the processing station.

2. A method as in claim 1 wherein a simultaneous detecting of the first and second position locator portions occurring after said dithering causes, first, a simultaneous stepping back of both side edges followed by a continuous advancing of both side edges in a forward direction.

3. A method as in claim 1 comprising printing the position locator on the sheet in advance of an image printed on the sheet, a leading edge of the image being parallel to the first and second portions of the image locator.

4. A method as in claim 1 comprising engaging independently driven first and second nip rollers against opposite sides of the sheet for the continuous advancing of the sheet in a forward direction.

5. A method as in claim 4 wherein the dithering is accomplished by repeated reversals of the rotation of the nip rollers at the side edge of the sheet associated with the detected locator portion while continuously driving the nip roller at the opposite side of the sheet in a forward direction.

6. A method as in claim 5 wherein the dithering is at a rate of about 1 to 10 direction reversals per second.

7. A method as in claim 6 wherein the length of each forward and rearward step during dithering is about 1 to 10 mm.

8. A method as in claim 4 comprising:

a) providing a controller operatively connected to each of the independently driven nip rollers;

b) signaling the controller upon detecting a first portion of the position locator portion and the controller responding by causing the repeated dithering of the nip roller at the side edge of the sheet associated with the detected first portion of the position indicator while continuously driving the nip roller at the opposite side of the sheet in a forward direction; and c) signaling the controller upon detecting the second portion of the position locator and the controller responding by:

i) stopping both the first and second nip rollers, ii) stepping both nip rollers in a rearward direction, and then iii) continuously driving both nip rollers and advancing the sheet in a forward direction.

9. A method to correct skew of a sheet being fed in a forward direction, the sheet having machine readable aligned first and second fiducial marks adjacent a leading edge of the sheet and parallel to the leading edge of an image on the sheet, each of the fiducial marks being associated with one of the side edges of the sheet, the method comprising:

a) engaging nip rollers along each opposite side edge of the sheet, each of the nip rollers being associated with one of the first and second fiducial marks respectively;

b) continuously driving the nip rollers forward for advancing the sheet in a forward direction until a first of the fiducial marks is detected;

c) stopping the forward driving of a first of the nip rollers associated with the first detected fiducial mark;

d) initiating the dithering of the first nip roller to repeatedly step the edge of the sheet engaged by the first nip roller first rearward and then forward, each rearward and forward step resulting in a redetection of the first of the fiducial marks;

e) continuously driving a second nip roller associated with the opposite side of the sheet in a forward direction during the dithering of the first nip roller to skew the sheet, the continuous driving of the second nip roller and skewing of the sheet continuing until the fiducial mark associated with the second nip roller is detected; and thereafter f) restarting the continuous driving of the first and second nip rollers forward for advancing the sheet in a forward direction.

10. A method as in claim 9 comprising:

a) stopping both the dithering of the first nip roller and the continuous driving of the second nip roller upon detecting the fiducial mark associated with the second nip roller; and b) stepping both nip rollers rearward prior to restarting the continuous driving of the first and second nip rollers forward.

11. Apparatus to correct skew of a sheet being fed to a processing station, the sheet having aligned machine readable position locators associated respectively with first and second side edges of the sheet wherein a proper orientation of the sheet entering the processing station is defined by an alignment of the position locators, the apparatus comprising:

a) first and second aligned sensors positioned to detect passage of a respective one of the position locators;

b) independently driven first and second nip rollers engageable against respective opposite side edges of the sheet and being selectively operable to move the sheet in either a forward direction towards the processing station or in a rearward direction;

c) a controller acting responsive to the detection of a first position locator by the first sensor to dither the first nip roller by alternately stepping the first nip roller rearward and then forward while continuously operating the second nip roller in a forward direction thereby skewing the sheet; and d) the controller acting responsive to the detection of the second position locator by the second sensor to move both nip rollers in a forward direction.

12. Apparatus as in claim 11 wherein the nip rollers are each driven by a stepper motor.

13. Apparatus as in claim 12 wherein the rate of the dithering of the first nip roller is about 1 to 10 direction reversals per sec.

14. Apparatus as in claim 13 wherein the length of each forward and rearward step during dithering is about 1 to 10 mm.

15. Apparatus as in claim 11 wherein the controller operates to stop both the dithering of the first nip roller and the continuous forward operation of the second nip roller upon detection of the second position locator by the second sensor and thereafter steps both nip rollers rearward prior to moving both nip rollers in a forward direction.

* * * * *